US007905378B2

(12) United States Patent
Liang et al.

(10) Patent No.: US 7,905,378 B2
(45) Date of Patent: Mar. 15, 2011

(54) TRIGGER VALVE FOR NAIL GUN

(75) Inventors: Chia-Sheng Liang, Taipei Hsien (TW); Yi-Hui Chen, Taipei Hsien (TW)

(73) Assignee: De Poan Pneumatic Corp., Taipei Hsien (TW)

( * ) Notice: Subject to any disclaimer, the term of this patent is extended or adjusted under 35 U.S.C. 154(b) by 258 days.

(21) Appl. No.: 12/363,797

(22) Filed: Feb. 2, 2009

(65) Prior Publication Data

US 2010/0193560 A1 Aug. 5, 2010

(51) Int. Cl.
*B25C 1/04* (2006.01)

(52) U.S. Cl. ..... 227/8; 227/121; 227/130

(58) Field of Classification Search ..... 227/5, 8, 227/121, 125, 129, 130
See application file for complete search history.

(56) References Cited

U.S. PATENT DOCUMENTS

| | | | | | |
|---|---|---|---|---|---|
| 3,685,396 | A * | 8/1972 | Obergfell | 91/356 |
| 3,774,293 | A * | 11/1973 | Golsch | 29/432.1 |
| 4,040,554 | A * | 8/1977 | Haytayan | 227/8 |
| 4,260,092 | A * | 4/1981 | Austin | 227/8 |
| 4,351,464 | A * | 9/1982 | Fehrs et al. | 227/7 |
| 4,405,071 | A * | 9/1983 | Austin | 227/7 |
| 4,509,668 | A * | 4/1985 | Klaus et al. | 227/8 |
| 4,784,308 | A * | 11/1988 | Novak et al. | 227/130 |
| 4,811,882 | A * | 3/1989 | Steeves et al. | 227/8 |
| 5,020,712 | A * | 6/1991 | Monacelli | 227/8 |
| 5,137,197 | A * | 8/1992 | Bauer | 227/8 |
| 5,441,192 | A * | 8/1995 | Sugita et al. | 227/130 |
| 5,579,975 | A * | 12/1996 | Moorman | 227/8 |
| 6,135,871 | A * | 10/2000 | Jones | 452/62 |
| 6,371,348 | B1 * | 4/2002 | Canlas et al. | 227/8 |
| 6,745,928 | B2 * | 6/2004 | Ishizawa et al. | 227/130 |
| 6,857,547 | B1 * | 2/2005 | Lee | 227/8 |
| 7,014,089 | B2 * | 3/2006 | Ishizawa et al. | 227/130 |
| 7,137,540 | B2 * | 11/2006 | Terrell et al. | 227/8 |
| 7,213,733 | B1 * | 5/2007 | Wen | 227/8 |
| 7,322,426 | B2 * | 1/2008 | Aguirre et al. | 173/1 |
| 7,516,876 | B2 * | 4/2009 | Ohmori | 227/119 |
| 7,677,426 | B2 * | 3/2010 | Tillinghast et al. | 227/130 |
| 7,762,442 | B2 * | 7/2010 | Liang et al. | 227/2 |
| 2007/0075113 | A1 * | 4/2007 | Tillinghast et al. | 227/130 |

* cited by examiner

*Primary Examiner* — Paul R Durand
(74) *Attorney, Agent, or Firm* — Chun-Ming Shih

(57) ABSTRACT

A trigger valve includes a valve base, a valve rod, a sliding portion and a shuttle valve. The valve base is disposed at a gun body of the nail gun between a compressed chamber and a main air valve of the nail gun. The valve rod is capable of being driven by a trigger of the nail gun to move so as to open or close high pressure air from the compressed chamber into the valve base. The sliding portion is capable of being driven by high pressure air to move to cause a safety slide rod of the nail gun producing a displacement along a hitting-nail direction. The shuttle valve is capable of being driven to move under control of the displacement of the sliding portion so as to open or close high pressure air from the valve base into the main air valve.

17 Claims, 16 Drawing Sheets

TRIGGER VALVE FOR NAIL GUN

BACKGROUND

The present invention relates to a trigger valve for a pneumatic nail gun, and more particularly to a trigger valve, which is capable of controlling hitting-nail action of a pneumatic nail gun with the trigger valve according to a thickness of a workpiece.

Generally, when an operator wants to use a pneumatic nail gun to join one workpiece (e.g., gasket, etc) with a through hole to another workpiece, a nail is required to be aimed at the through hole in advance, so that the nail can be exactly extended through the through hole and nailed into the another workpiece. For easily aiming the nail at the through hole, a nail gun with a nail exposed outside of a gunpoint thereof, has been developed in the related art.

The thickness of the one workpiece is usually varied. To make the nail gun capable of automatically selecting the one workpiece of suitable thickness, a main air passage between a trigger valve and a main air valve typically has a control vale, which is actuated to set the nail gun in the status of hitting nails when a hitting base on a bottom end of a safety slide rod of the nail gun downwardly moves into a predesigned height range above the one workpiece. The predesigned height includes a thickness and a depth of a through hole of the one workpiece of suitable thickness. Thus, the conditions when the control vale to be actuated, are designed according to a displacement of the movement of the hitting base to the predesigned height. That is, the operator can insert into the through hole a tip of the nail exposed outside of a gunpoint of the nail gun, and the tip contacts a surface of the another workpiece, and the hitting base moves along a hitting-nail direction to press the one piece. The displacement of the hitting base represents (reflects or implicates) the relative distance between the tip of the nail and the hitting base, which is the thickness and the depth of the through hole of the one workpiece. When the thickness and the depth of the through hole of the one workpiece measure up the predesigned height range, the control valve is actuated to help the trigger valve to drive the high pressure air, so as to open the main air valve and power the nail gun to hit nails.

In the related arts, a pneumatic nail gun with a hitting-nail control device equivalent to the above control valve can be found in US Public No. 2007/0075113. The hitting-nail control device includes a swinging rod driven by a safety slide rod, and a valve rod braked or released by the swinging rod. The safety slide rod indirectly brakes or releases the valve rod, so as to control the high pressure air to drive a main air valve to open and then power the nail gun to hit nails. However, the pneumatic nail gun disclosed in US Public No. 2007/0075113 has several disadvantages: the valve rod is driven to move by the limited volume of high pressure air from main air valve and is indirectly braked or released by the swinging rod, thus, the nail gun has poor control stability. Further, the swinging rod is positioned between the valve rod and the safety slide rod, which makes the structure of the nail gun unduly complicated and it is bad for maintaining stability after long-time use. Moreover, the installation of the hitting-nail control device or a valve body on the nail gun having the trigger valve, will unduly increase the complexity in air passage design and hitting-nail control and the weight of the nail gun, and decrease space of the nail gun for continuously gathering high pressure, and makes the cost unduly high. Accordingly, the nail gun is urgently needed to be improved.

BRIEF SUMMARY

A trigger valve of a pneumatic nail gun is provided, and can be used in a pneumatic nail gun, which is capable of controlling hitting-nail action according to a thickness of a workpiece. Structures such as drives for hitting nails and controls of hitting nails are integrated into the single trigger valve, this simplifies the nail gun and improves stability after long-time use of the nail gun. Furthermore, the safety slide rod is directly driven to locate, this improves control stability.

The trigger valve of a pneumatic nail gun includes:

a valve base disposed at a gun body of the nail gun between a compressed chamber and a main air valve of the nail gun;

a valve rod sliding received in the valve base, being capable of being driven by a trigger of the nail gun to move so as to open or close high pressure air from the compressed chamber into the valve base;

a sliding portion sliding received in the valve base, being capable of being driven by high pressure air to move to cause a safety slide rod of the nail gun producing a displacement along a hitting-nail direction; and a shuttle valve sliding received in the valve base and nested with the sliding portion, the shuttle valve being capable of being driven to move under control of the displacement of the sliding portion so as to open or close high pressure air from the valve base into the main air valve.

With these configurations, when the trigger is pressed, the valve rod is driven to move causing the higher pressure air in the compressed chamber flowing into the valve base. The sliding portion in the valve base is then driven by the high pressure air to move, and this causes the safety slide rod producing a displacement along a hitting-nail direction. The shuttle valve is actuated to open under control of the displacement of the sliding portion so that the high pressure air in the valve base flows into the main air valve so as to power the nail gun to hit nails.

Thus, structures such as drives for hitting nails and controls of hitting nails are integrated into the single trigger valve, this simplifies the nail gun and improves stability after long-time use of the nail gun. Furthermore, the safety slide rod is directly driven to locate, this improves control stability.

Furthermore, the trigger valve further includes following features.

The valve base is disposed at an end of the gun body. The valve base includes a top guide groove and a bottom guide groove defined therein, the bottom guide groove connecting with the top guide groove. A first valve hole is disposed in a top end of the valve base, the first valve hole connecting with the compressed chamber and the top guide groove. The valve rod is sliding received in the top guide groove and includes an air-guiding passage defined therein, the air-guiding passage connecting the first valve hole and the bottom guide groove. The valve rod further includes a first valve stopper formed on an outer peripheral surface of a top end thereof. The first valve stopper is capable of controlling the first valve hole to open or close.

The air-guiding passage includes at least one air inputting passage, which is formed in the outer peripheral surface of the top end of the valve rod below the first valve stopper. The first valve stopper is located in the top guide groove and closes the first valve hole. When the trigger is pressed, the valve rod with the first valve stopper is driven to move along a direction opposite to the hitting-nail direction, and the first valve stopper moves to an outside of the top guide groove to open the first valve hole.

A second valve hole is defined in a connecting portion between the top guide groove and the bottom guide groove. The valve base further includes at least one travel slot defined in a side portion of the top end thereof, the at least one travel slot connecting with the top guide groove and the atmosphere. A second valve stopper is disposed at an outer peripheral of the valve rod, which is located between the top and bottom guide grooves, the second valve stopper can open or close the second valve hole.

The second valve stopper is located outside of the top guide groove and opens the second valve hole. When the trigger is pressed, the valve rod with the second valve stopper is driven to move along a direction opposite to the hitting-nail direction, and the second valve stopper moves into the top guide groove to close the second valve hole.

The valve rod includes a pole disposed at an end thereof. The pole is sliding received in the travel slot and exposed outside of side end portions of the valve base. The pole is capable of being driven by the trigger to drive the valve rod to move.

A first elastic element is nested with the sliding portion, for inducing the sliding portion to move along a direction opposite to the hitting-nail direction to keep the sliding portion elastically and sliding locating in the bottom guide groove. A bottom portion of the valve rod extends into the bottom guide groove. An axial hole is formed in a top portion of the sliding portion and is nested with the bottom portion of the valve rod.

The air guiding passage includes at least one air exhausting passage, which is formed in an outer peripheral surface of the bottom portion of the valve rod. The sliding portion is connected with the safety slide rod.

A second elastic element is located between the shuttle valve and an inner wall of the bottom guide groove, for inducing the shuttle valve to move along the hitting-nail direction to keep the shuttle valve elastically and sliding locating in the bottom guide groove.

The valve base includes at least one air exhausting hole defined in a side portion of a bottom portion thereof, the at least one air exhausting hole connecting with the bottom guide groove and the main air valve. The shuttle valve divides the bottom guide groove into a first air room and a second air room. The first air room connects with the top guide groove. The shuttle valve includes a guide hole defined therein, which connects with the first air room and the second air room. The shuttle valve further includes at least one through hole defined in side portions thereof. The through hole connects with the guide hole and the air exhausting hole. A third valve hole is defined in a connecting portion between the guide hole and the first air room. The sliding portion is sliding received in the guide hole and includes a third valve stopper formed on the outer periphery thereof. The third valve stopper is capable of controlling the third valve hole to open or close.

The third valve stopper is located in the guide hole above the through hole and closes the third valve hole. The sliding portion is driven by high pressure air to cause the third valve stopper moving into the guide hole below the through hole along the hitting-nail direction so that the third valve hole is opened to connect with the through hole and the air exhausting hole.

The sliding portion is driven by high pressure air to cause the third valve stopper moving away from the guide hole along the hitting-nail direction, so as to open the third valve hole to connect with the second air room, so that the shuttle valve is driven by high pressure air to move along a direction opposite to the hitting-nail direction so as to block the air exhausting hole.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
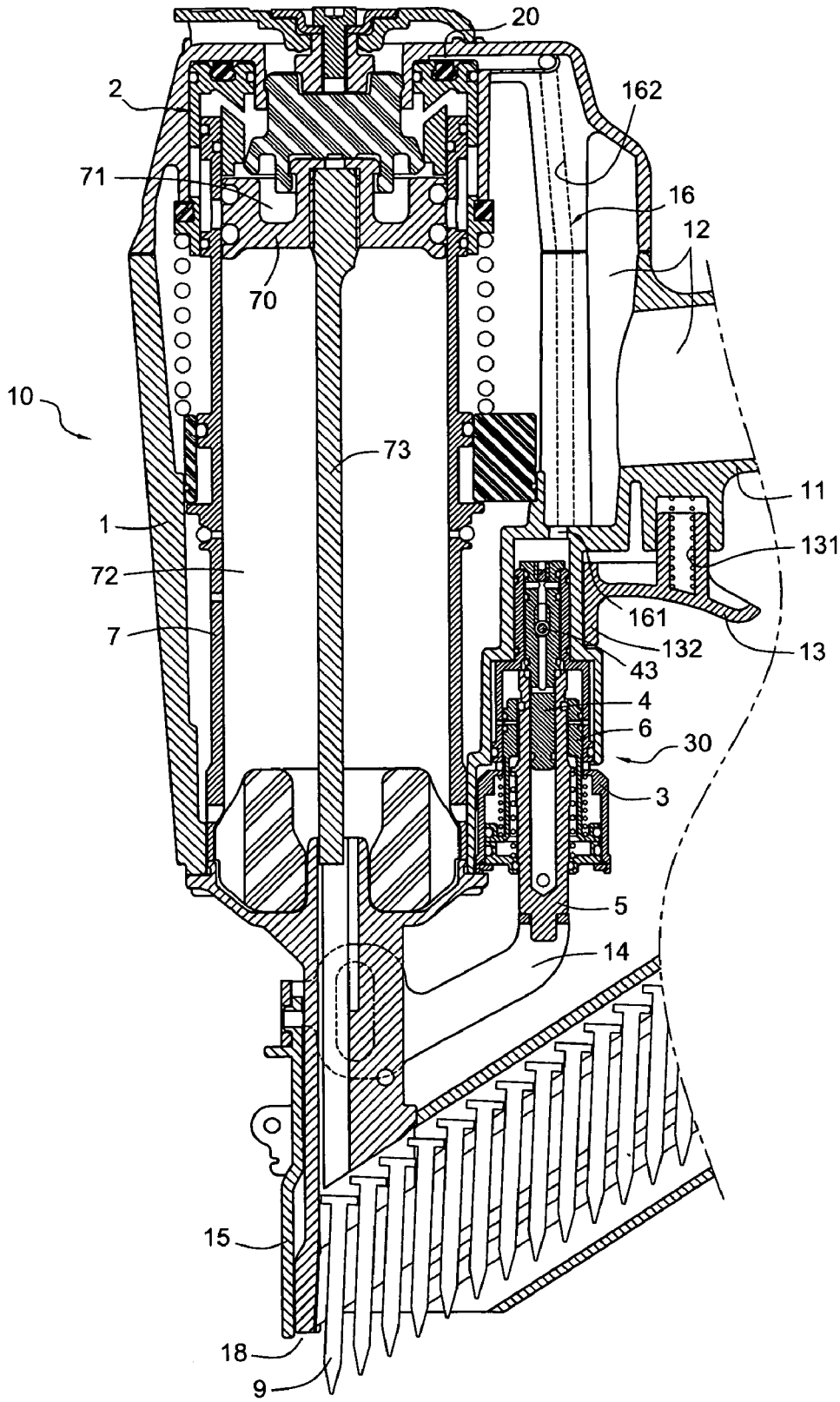
FIG. 1 is a cross-sectional view of several elements of a nail gun according to an exemplary embodiment of the present invention.
Figure 2:
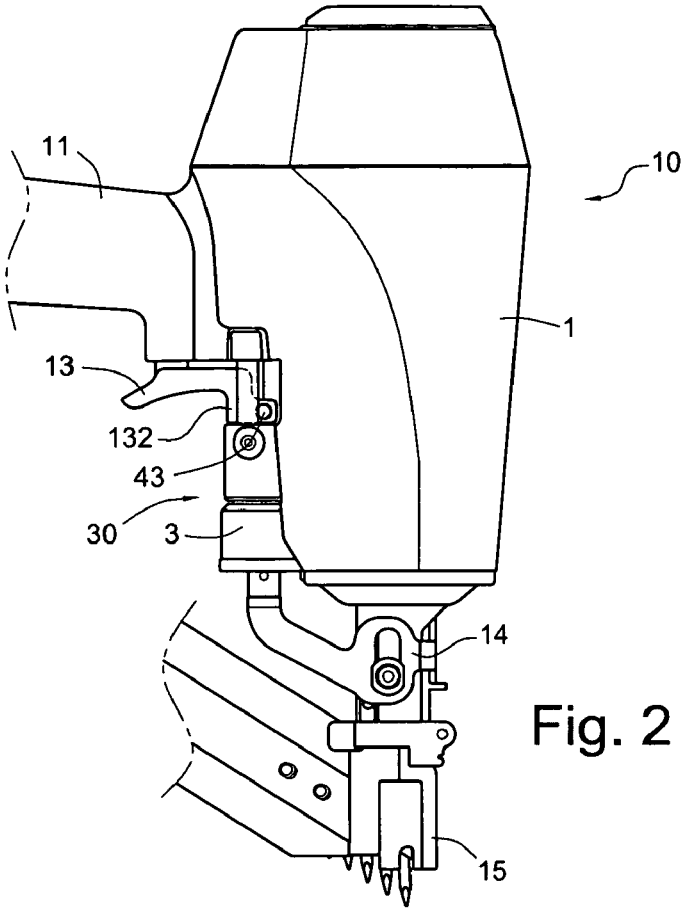
FIG. 2 is a perspective view of the nail gun of FIG. 1.
Figure 4:
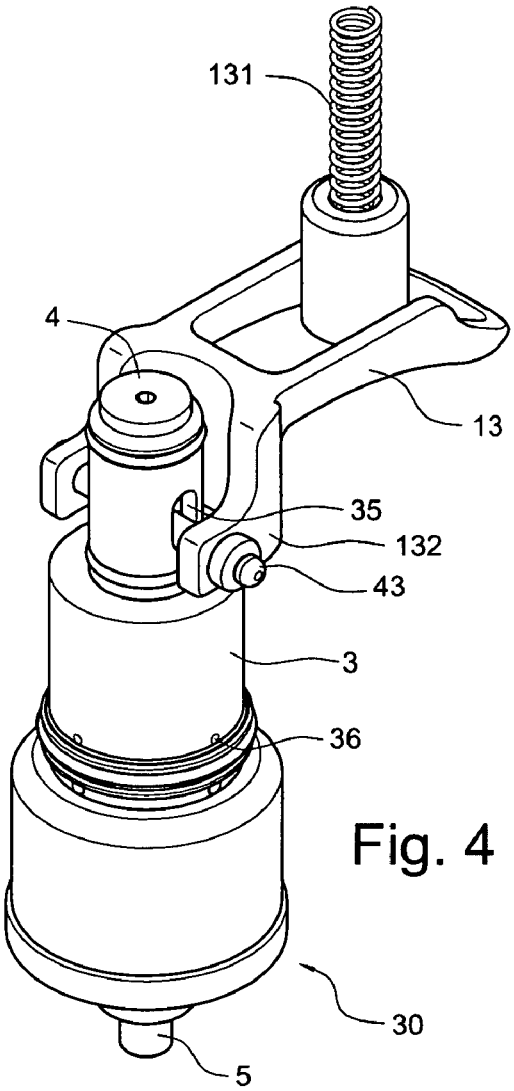
FIG. 4 is a three-dimensional view of a trigger valve of the nail gun of FIG. 1.
Figure 5:
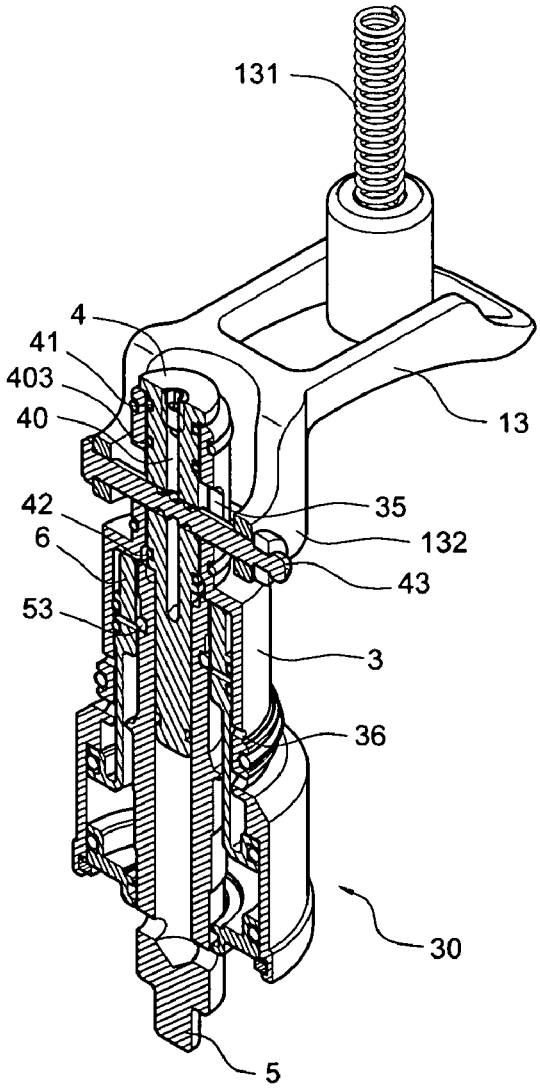
FIG. 5 is a cross-sectional view of FIG. 4.
Figure 11:
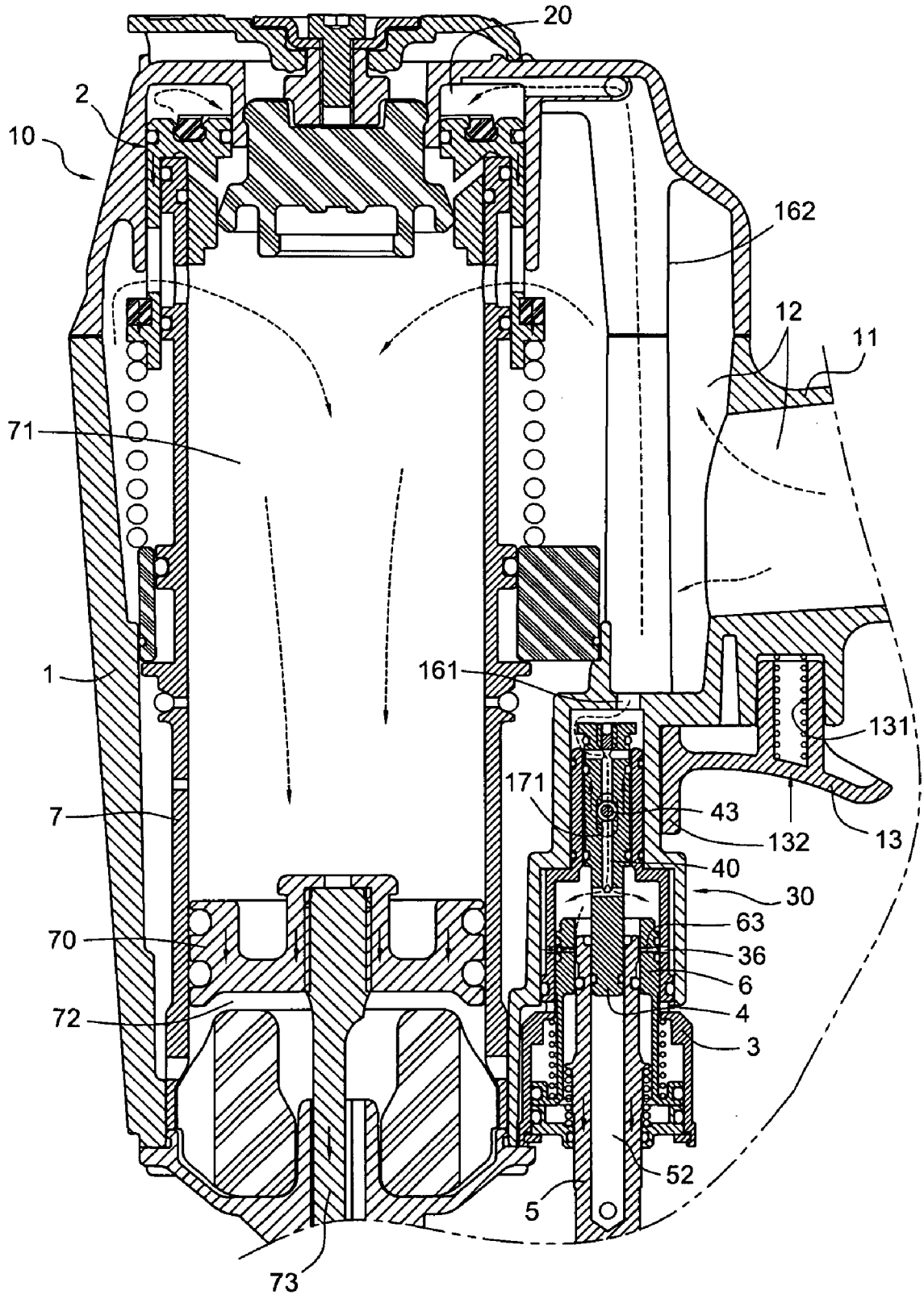
FIG. 11 is a view similar to FIG. 9, showing the operating status thereof.

Referring to FIG. 1, a cross-sectional view of a trigger valve of a nail gun according to an exemplary embodiment of the present invention is shown. The trigger valve 30 includes a valve base 3, a valve rod 4, a sliding portion 5 and a shuttle valve 6. The valve base 3 is disposed at an end of a gun body 1 of the nail gun 10 (as shown in FIGS. 2, 4, and 5), adjacent to a grip 11 disposed at an end of the gun body 1. Further, the valve base 3 connects between a compressed chamber 12 and a main air valve 2 of the nail gun 10. The valve rod 4 is sliding received in the valve base 3, and is capable of being driven to move by a trigger 13 of the nail gun 10 (as shown in FIG. 11), so that the high pressure air in the compressed chamber 12 can be guided or prevented from flowing into the valve base 3. The sliding portion 5 is sliding received in the valve base 3, and is capable of being driven by the high pressure air to move. The sliding portion 5 moves together with a safety slide rod 14 of the nail gun 10 and a hitting base 15 disposed on a bottom end of the safety slide rod 14 along a hitting-nail direction, and a displacement h1 is produced (as shown FIGS. 12-14). The shuttle valve 6 is sliding received in the valve base 3, and nested with an outer periphery of the sliding portion 5. The shuttle valve 6 is capable of moving under control of the displacement of the sliding portion 5 (as shown FIGS. 18-20), so that the high pressure air in the valve base 3 can be guided or prevented from flowing into the main air valve 2.

Figure 8:
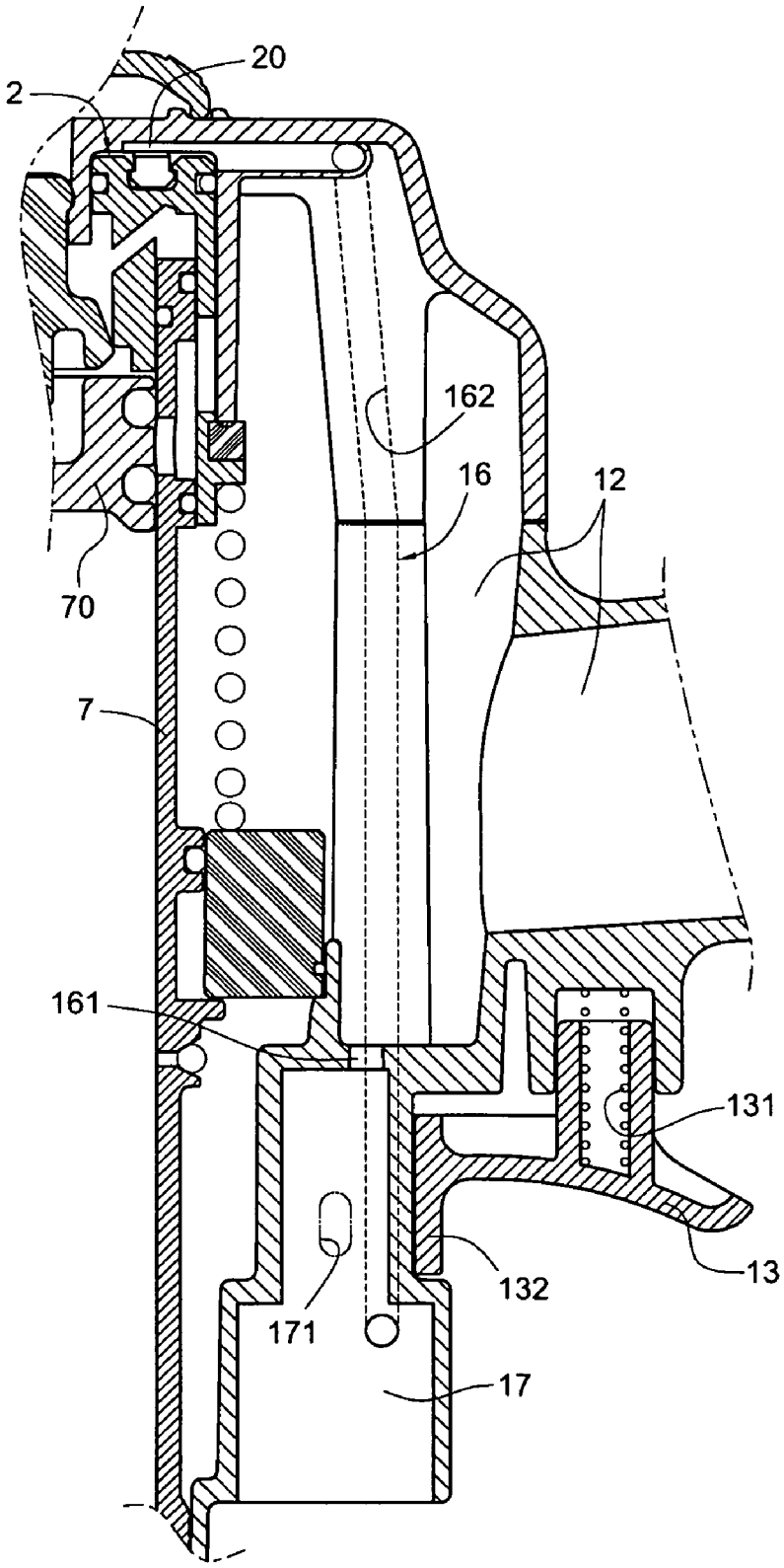
FIG. 8 is a cross-sectional view of a main air passage of the nail gun of FIG. 1.
Figure 9:
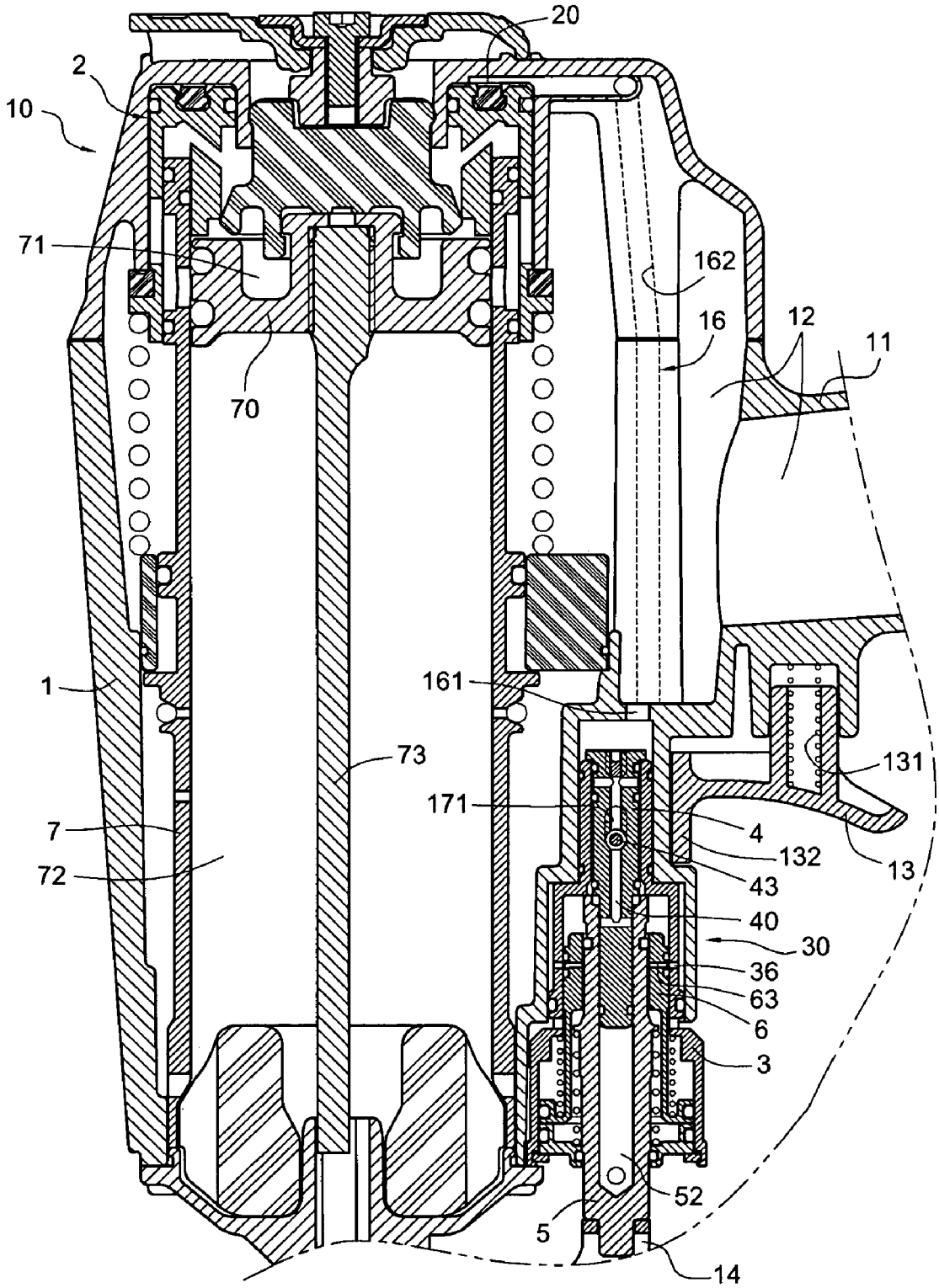
FIG. 9 is a partly enlarged view of FIG. 1.
Figure 13:
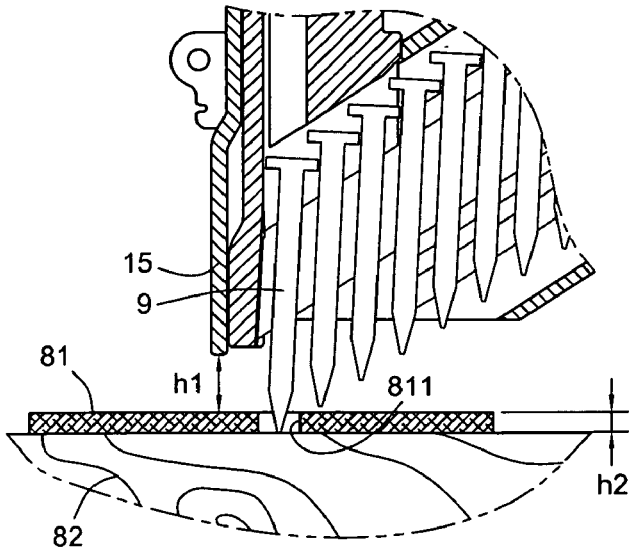
FIG. 13 is a schematic, enlarged view of the hitting base of FIG. 1, showing the operating status thereof.
Figure 14:
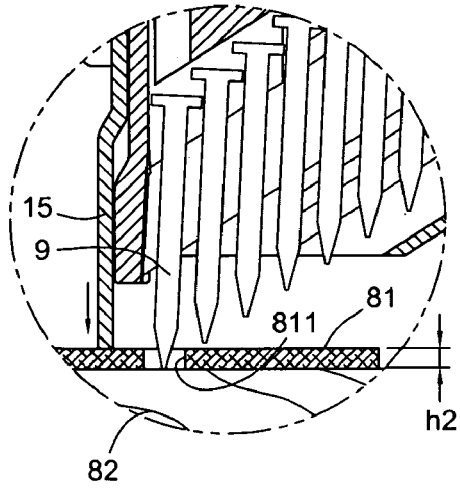
FIG. 14 is a view similar to FIG. 13, showing the continuously operating status thereof.

The gun body 1 includes a cylinder 7 disposed therein (as shown in FIG. 1). The main air valve 2 is disposed in the gun body 1 above the cylinder 7. The compressed chamber 12 is disposed outside of the main air valve 2 and the cylinder 7, and also disposed in the grip 11. The compressed chamber 12 is for concentrating air and maintain a certain high pressure therein. The gun body 1 has a main air passage 16 formed therein (as shown in FIG. 8). The gun body 1 has a receiving groove 17 formed in an end portion thereof and extending along the hitting-nail direction. The main air passage 16 is divided into a first air passage 161 and a second air passage 162, and the first air passage 161 and the second air passage 162 connect with the receiving groove 17, respectively. The valve base 3 is installed in the receiving groove 17 so that the first air passage 161 connects the compressed chamber 12 with the valve base 3 and the second air passage 162 connects the valve base 3 and the main air valve 2. The trigger 13 is elastically and sliding mounted on an end of the grip 11 via a spring 131, for fingers pressing. The safety slide rod 14 is sliding disposed on the gun body 1. A top end portion of the safety slide rod 14 is connected with a bottom portion of the sliding portion 5. A bottom end portion of the safety slide rod 14 is connected with the hitting base 15. The hitting base 15 extends to beyond a distal end of a gunpoint 18, which is located at a bottom portion of the gun body 1. The hitting base 15 is capable of moving along the hitting-nail direction to press a working piece 81 (as shown in FIGS. 13-14). The main air valve 2 is capable of being actuated to be driven by the high pressure air in the main air passage 16, so that the high pressure air in the compressed chamber 12 can be guided or prevented from flowing into the cylinder 7 (as shown in FIG. 9 and FIG. 11) to power the nail gun 10 to hit nails.

Figure 3:
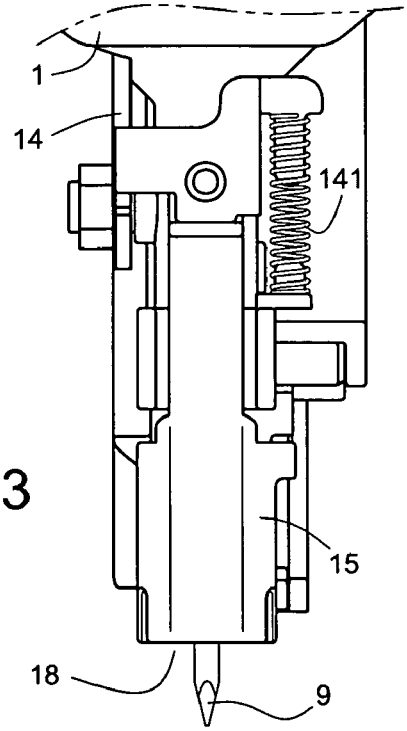
FIG. 3 is a schematic view of a safety slide rod and a hitting base of the nail gun of FIG. 1.

The main air valve 2 includes a main air chamber 20 (as shown in FIG. 1 and FIG. 8). The main air chamber 20 connects with the second air passage 162. The main air chamber 20 is capable of concentrating high pressure air from the second air passage 162 to actuate the main air valve 2 to open a top portion of the cylinder 7 (as shown in FIG. 11), so that the high pressure air in the compressed chamber 12 are guided into the cylinder 7. The cylinder 7 has a piston 70 slinding received therein. The piston 70 divides an inner portion of the cylinder 7 into a top cylinder chamber 71 and a bottom cylinder chamber 72. The cylinder 7 has a drive rod 73 connected to a bottom portion thereof. A spring 141 (as shown in FIG. 3) is disposed between an end of the safety slide rod 14 and a bottom end of the gun body 1. The spring 141 drives the safety slide rod 14 with the hitting base 15 to upwardly move, so that a nail 9, installed in a drive track at the bottom end of the gun body 1, is exposed outside of the gunpoint 18 and the hitting base 15.

Of course, the illustrated embodiment of the main air valve 2 and the cylinder 7 is only a preferred embodiment of the present invention, and not intended to be limiting in any way. In other words, other arrangements which can use high pressure air to actuate the main air valve 2 so as to drive high pressure air into the cylinder 7, and which includes main air valves and cylinders with same functions in the related art, can be adopted in other embodiments of the present invention.

The preferred embodiment will be described in more details.

Figure 6:
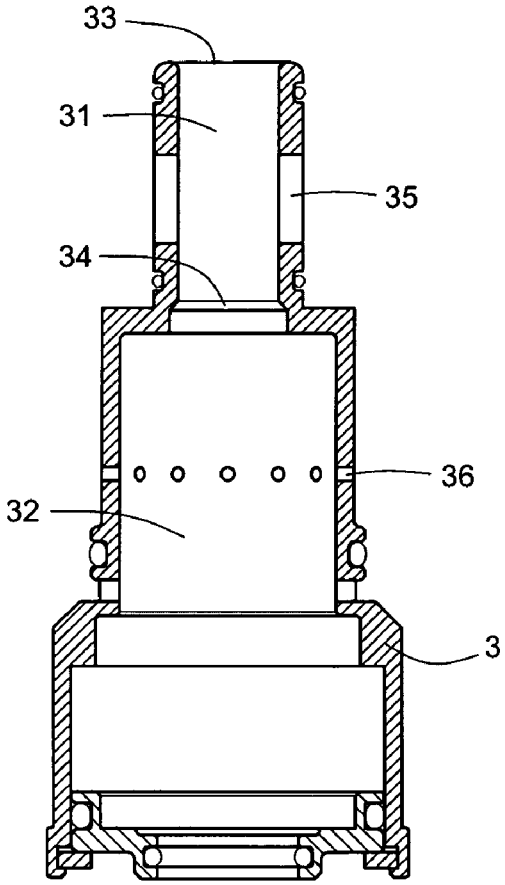
FIG. 6 is a cross-sectional view of a valve base of the nail gun of FIG. 1.
Figure 10:
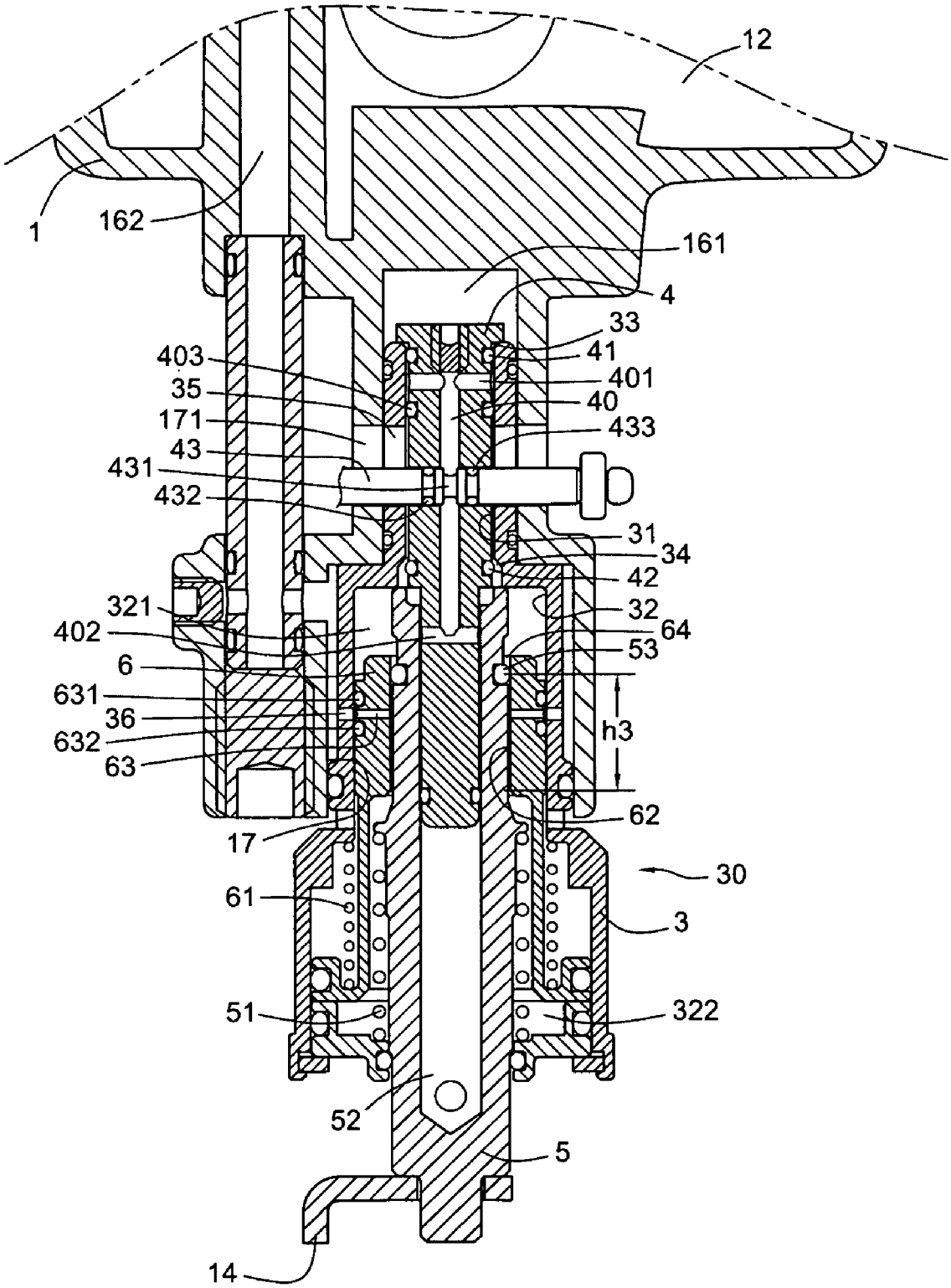
FIG. 10 is an enlarged, cross-sectional view of the trigger valve.
Figure 12:
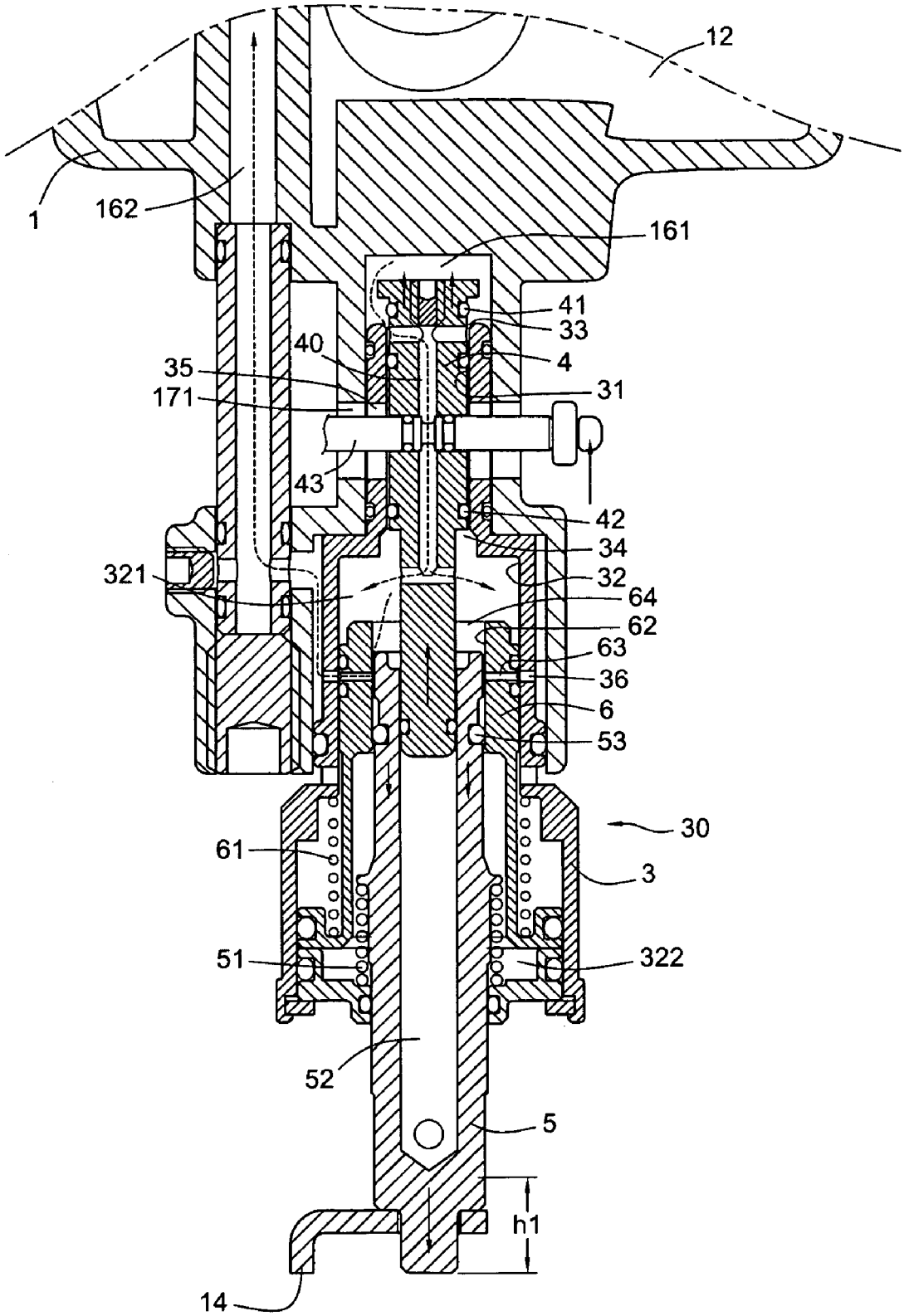
FIG. 12 is an enlarged view of the trigger valve of FIG. 11, showing the operating status thereof.

The valve base 3 includes a top guide groove 31 and a bottom guide groove 32 defined therein, the bottom guide groove 32 connecting with the top guide groove 31 (as shown in FIG. 6 and FIG. 10). The valve base 3 includes a first valve hole 33 disposed in a top end thereof. The first valve hole 33 connects with the first air passage 161, the compressed chamber 12 and the top guide groove 31. The valve rod 4 is sliding received in the top guide groove 31, and has an air-guiding passage 40 defined therein (as shown in FIG. 5). The air-guiding passage 40 connects the first valve hole 33 and the bottom guide groove 32. The valve rod 4 includes a first valve stopper 41 formed on an outer peripheral of a top end thereof. The valve rod 4 can control the first valve hole 33 (as shown in FIG. 12) to open or close. The air-guiding passage 40 includes at least one air inputting passage 401, which is formed in the outer periphery of the top end of the valve rod 4 below the first valve stopper 41. In this embodiment, the at least one air inputting passage 401 includes several air inputting passages 401. The first valve stopper 41 is located in the top guide groove 31 when the trigger 13 is not pressed, and closes the first valve hole 33.

In a connecting portion between the top guide groove 31 and the bottom guide groove 32, a second valve hole 34 is defined (as shown in FIG. 6 and FIG. 10). At a side portion of a top portion of the valve base 3, at least one travel slot 35 is defined and connects with the top guide groove 31 and the atmosphere (as shown in FIGS. 4-5). In this embodiment, two travel slots 35 are defined in opposite side portions of the top portion of the valve base 3. A second valve stopper 42 is disposed at the outer periphery of the valve rod 4, which is located between the first and second guide grooves 31, 32. The second valve stopper 42 can open or close the second valve hole 34 (as shown in FIG. 12). The second valve stopper 42 is located outside of the top guide groove 31 when the trigger 13 is not pressed, and opens the second valve hole 34. The first and second valve stoppers 41, 42 each may be an air tight ring. An air tight ring 403 is disposed at the outer periphery of the top end of the valve rod 4, which is located below the air input passage 401. The air tight ring 403 prevents the high pressure air following from the first valve hole 33 from exhausting toward the atmosphere through the bottom guide groove 32 and the travel slot 35.

Two end slots 171 are defined in opposite end portions of the receiving groove 17 (as shown in FIGS. 8-10). The end slots 171 are corresponding to the travel slots 35 of the valve base 3, respectively. The valve rod 4 includes a pole 43 disposed at an end thereof (as shown in FIGS. 4-5). The pole 43 is sliding received in the travel slots 35 and extends exposed outside of side end portions of the valve base 3. In this embodiment, the pole 43 is extended through the valve rod 4 with opposite ends of the pole 43 exposed outside of opposite sides of the valve rod 4. Further, the opposite ends of the pole 43 are respectively received in the travel slots 35 and extended through the end slots 171 to expose outside of side portions of the gun body 1. The trigger 13 includes two side plates 132, which extend to two side portions of the valve base 3, respectively, and located outside of the gun body 1 (as shown in FIG. 2). The pole 43 is pivotally attached between the two side plates 132. The pole 43 is capable of being driven by the trigger 13 to drive the valve rod 4 to move (as shown in FIGS. 11-12).

A portion of the pole 43 extending in the air-guiding passage 40, has an air-guiding channel 431 defined therein to make the air-guiding passage 40 unobstructed (as shown in FIG. 10). Two air tight rings 432, 433 are disposed at an outer wall of the pole 43 at opposite sides of the air-guiding channel 431, and the air tight rings 432, 433 are embedded in the valve rod 4 to prevent the high pressure air in the air-guiding passage 40 from exhausting toward the atmosphere through leakage between the valve rod 4 and the pole 43.

A first elastic element 51 is nested with the sliding portion 5 (as shown in FIG. 10). The first elastic element 51 may be a spring and is used for inducing the sliding portion 5 to move along a direction opposite to the hitting-nail direction, so as to keep the sliding portion 5 elastically and sliding locating in the bottom guide groove 32. A bottom portion of the valve rod 4 extends into the bottom guide groove 32. An axial hole 52 is formed in a top portion of the sliding portion 5, and is nested with the bottom portion of the valve rod 4. The air-guiding passage 40 includes at least one air exhausting passage 402, which is formed in an outer periphery of the bottom portion of the valve rod 4. In this embodiment, the at least one air exhausting passage 402 includes several air exhausting passages 402.

A second elastic element 61 is located between the shuttle valve 6 and an inner wall of the bottom guide groove 32 (as shown in FIG. 10). The second elastic element 61 may be a spring and is used for inducing the shuttle valve 6 to move along the hitting-nail direction, so as to keep the shuttle valve 6 elastically and sliding locating in the bottom guide groove 32.

Figure 7:
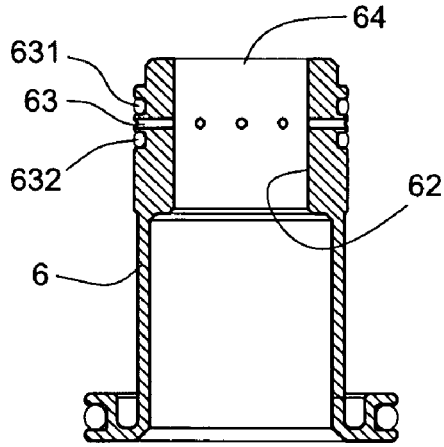
FIG. 7 is a cross-sectional view of a shuttle valve of the nail gun of FIG. 1.

The valve base 3 includes at least one air exhausting hole 36 defined in side portions of a middle portion thereof (as shown in FIG. 6 and FIGS. 9-10). In this embodiment, the at least one air exhausting hole 36 includes several air exhausting holes 36, which connect with the bottom guide groove 32, the second air passage 162 and the main air valve 2. Furthermore, the shuttle valve 6 divides the bottom guide groove 32 into a first air room 321 and a second air room 322. The first air room 321 connects with the top guide groove 31. The shuttle valve 6 includes a guide hole 62 defined therein, which connects with the first air room 321 and the second air room 322 (as shown in FIG. 7). The shuttle valve 6 further includes at least one through hole 63 defined in side portions thereof, and the through hole 63 connects with the guide hole 62 and the air exhausting hole 36. In this embodiment, the at least one through hole 63 includes several through holes 63. Two air tight rings 631, 632 are disposed at an outer periphery of the shuttle valve 6 and located at opposite top and bottom sides of the through hole 63, respectively, so as to communicate the air exhausting hole 36 with the through hole 63. In a connecting portion between the guide hole 62 and the first air room 321, a third valve hole 64 is defined. The sliding portion 5 is sliding received in the guide hole 62. Furthermore, the sliding portion 5 has a third valve stopper 53 formed on the outer periphery thereof. The third valve stopper 53 is capable of controlling the third valve hole 64 to open or close (as shown in FIG. 12). The third valve stopper 53 is located in the guide hole 62 above the through hole 63 when the trigger 13 is not pressed (as shown in FIG. 10), and closes the third valve hole 64. The distance h3 that the third valve stopper 53 has moved along the hitting-nail direction before it gets away from the guide hole 62, defines the range of the above described displacement h1.

Based on the above description, the operation of the present invention will be described herein with reference to FIGS. 11-22.

Figure 15:
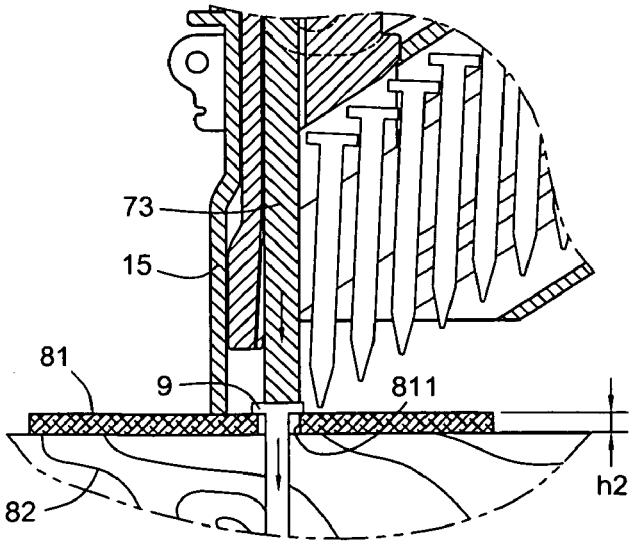
FIG. 15 is a view similar to FIG. 13, showing another continuously operating status thereof.

When an operator wants to use the nail gun 10 to join one workpiece 81 with a through hole 811 to another workpiece 82, a tip of the nail 9 which is exposed outside of the gunpoint 18 and the hitting base 15, is first inserted into the through hole 811 (as shown in FIG. 13) and contacts with a surface of the another workpiece 82. At this time, the hitting base 15 does not contact with a surface of the workpiece 81. When the operator presses the trigger 13 (as shown in FIGS. 11-12), the side plates 132 of the trigger 13 together with the pole 43 and the valve rod 4 move along the direction opposite to the hitting-nail direction, this causes the first valve stopper 41 to move along the direction opposite to the hitting-nail direction to the outside of the top guide groove 31, and the first valve hole 33 is opened. The second valve stopper 42 are also driven to move along the direction opposite to the hitting-nail direction into the top guide groove 31, and the second valve hole 34 is closed. At this time, the high pressure air in the compressed chamber 12 flows into the first air room 321 of the bottom guide groove 32 through the first air passage 161, the first valve hole 33, the top guide groove 31, the air inputting passage 401, the air-guiding passage 40 and the air exhausting passage 402. As a result, the sliding portion 5 together with the safety slide rod 14 and the hitting base 15 moves along the hitting-nail direction, and the hitting base 15 on the bottom end portion of the safety slide rod 14 moves into a range of the predesigned height h2 above the another workpiece 82, and then contacts with the surface of the one workpiece 81 (as shown in FIGS. 13-14). The predesigned height h2 includes a thickness and a depth of a through hole 811 of the one workpiece 81. The distance h3 (as shown in FIG. 10) that the third valve stopper 53 moves in the guide hole 62 along the hitting-nail direction is designed according to the predesigned height h2. Thus, the displacement h1 that the safety slide rod 14 and the hitting base 15 move along the hitting-nail direction, represents (reflects or implicates) the relative distance between the tip of the nail 9 and a bottom surface of the hitting base 15 as shown in FIG. 13, so as to check the thickness and the depth of the through hole 811 of the one workpiece 81. When the thickness and the depth of the through hole 811 of the one workpiece 81 measure up the predesigned range of the predesigned height h2, the sliding portion 5 produces a displacement h1 along the hitting-nail direction, so that the third valve stopper 53 moves into the guide hole 62 below the through hole 63 along the hitting-nail direction and the third valve hole 64 is opened to connect with the guide hole 62, the through hole 63 and the air exhausting hole 36. Therefore, the high pressure air in the first air room 321 are guided into the main air chamber 20 through the third valve hole 64, the guide hole 62, the through hole 63, the air exhausting hole 36 and the second air passage 162, and the main air valve 2 is actuated to open the top portion of the cylinder 7 so that the high pressure air in the compressed chamber 12 are guided into the top cylinder chamber 71. As a result, the piston 70 drives the drive rod 73 to downwardly move to hit the nail 9, and the nail 9 is hit into the surface of the another workpiece 82 so as to join the workpieces 81, 82 together (as shown in FIG. 15).

Thus, the present invention can feedback the thickness and the depth of the through hole 811 of the one workpiece 81 via the safety slide rod 14 and the hitting base 15, and then checks the feedback height of the safety slide rod 14 via the sliding portion 5 of the trigger valve 30 to control the compressed chamber 12 to close or open, so as to control the high pressure air in the compressed chamber 12 to power the nail gun 10 to hit the nail 9.

Figure 16:
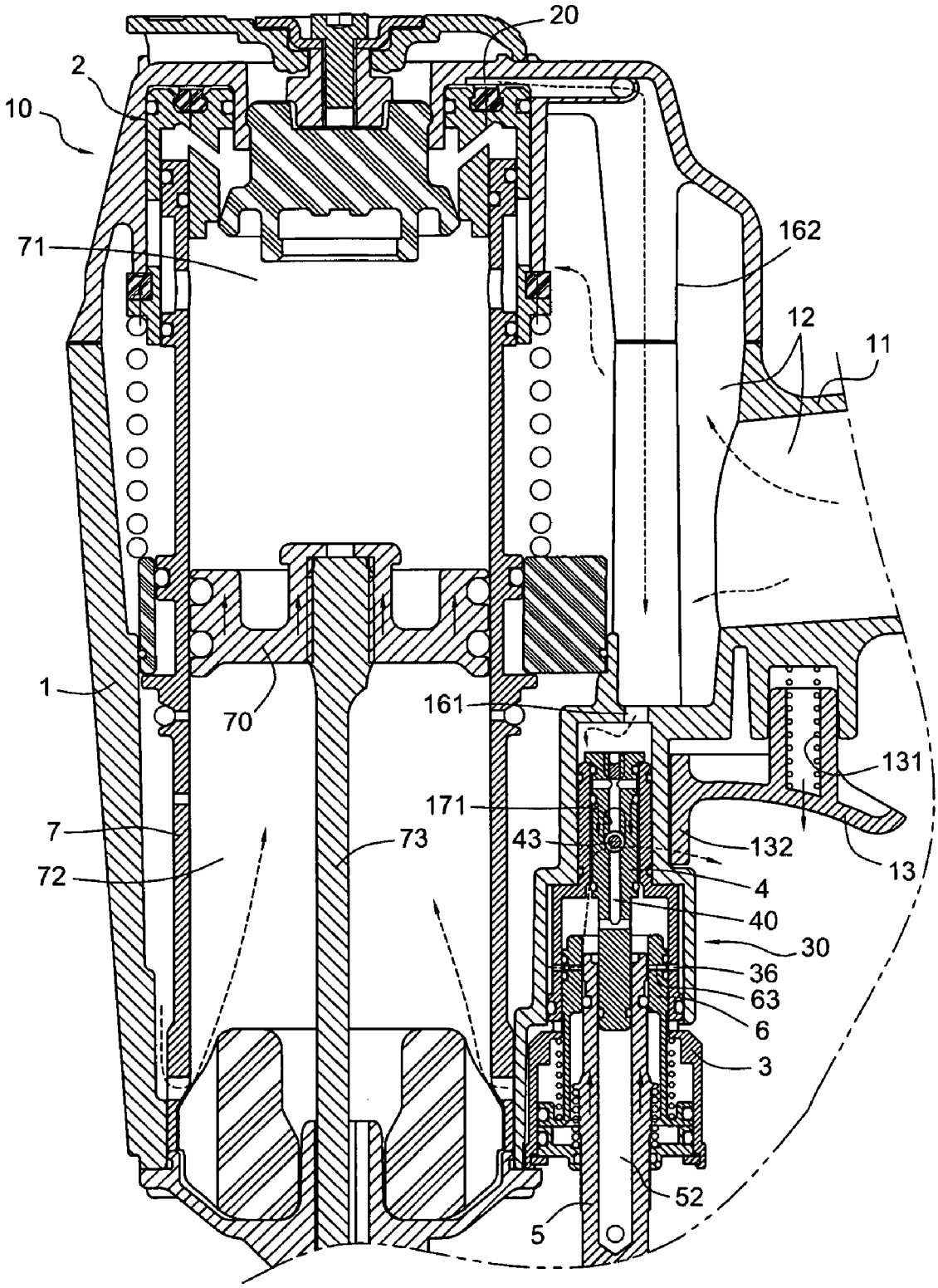
FIG. 16 is a view similar to FIG. 9, showing another operating status thereof.
Figure 17:
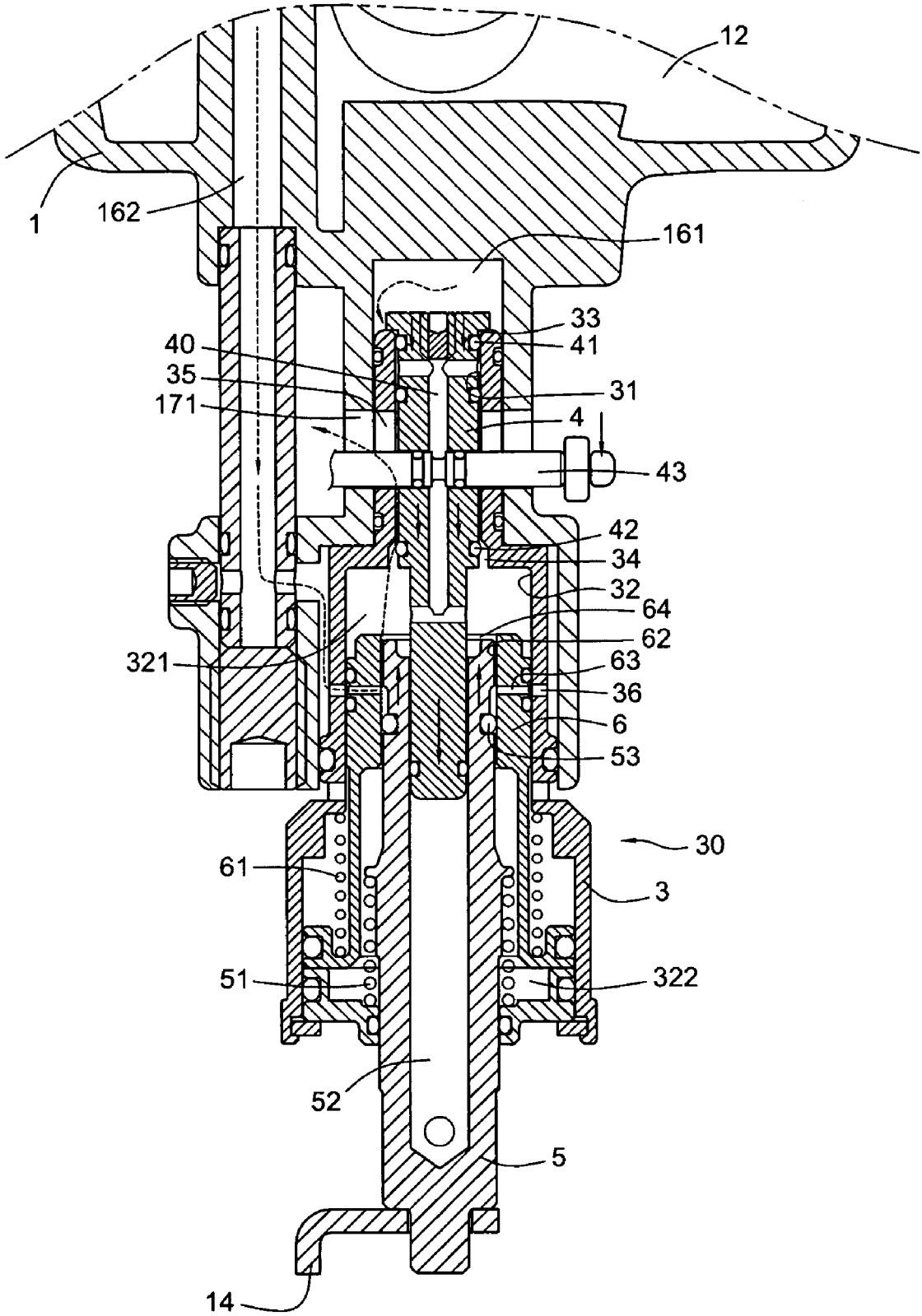
FIG. 17 is an enlarged view of the trigger valve of FIG. 16, showing the operating status thereof.

When the operator releases the trigger 13 (as shown in FIGS. 16-17), the spring 131 drives the side plates 132 of the trigger 13 with the pole 43 and the valve rod 4 to reposit to original positions. Meanwhile, the high pressure air in the compressed chamber 12 also drives the valve rod 4 to reposit to original position, and the first valve stopper 41 are driven to move into the top guide groove 31 along the hitting-nail direction to close the first valve hole 33. The second valve stopper 42 are driven to move outside of the top guide groove 31 to open the second valve hole 34. As a result, the high pressure air in the compressed chamber 12 can not be continuously guided into the trigger valve 30 and the main air chamber 20 via the first valve hole 33, and the high pressure air in the main air chamber 20, the second air passage 162 and the bottom guide groove 32 is exhausted to the atmosphere via the second valve hole 34, the top guide groove 31, the travel slot 35 and the end slots 171, so that the main air valve 2 is driven by the high pressure air from the compressed chamber 12 to close the top portion of the cylinder 7 so as to cause the piston 70 upwardly moving to reposit. At the same time, the spring 141 (as shown in FIG. 3) drives the safety slide rod 14 and the hitting base 15 to reposit again.

Figure 18:
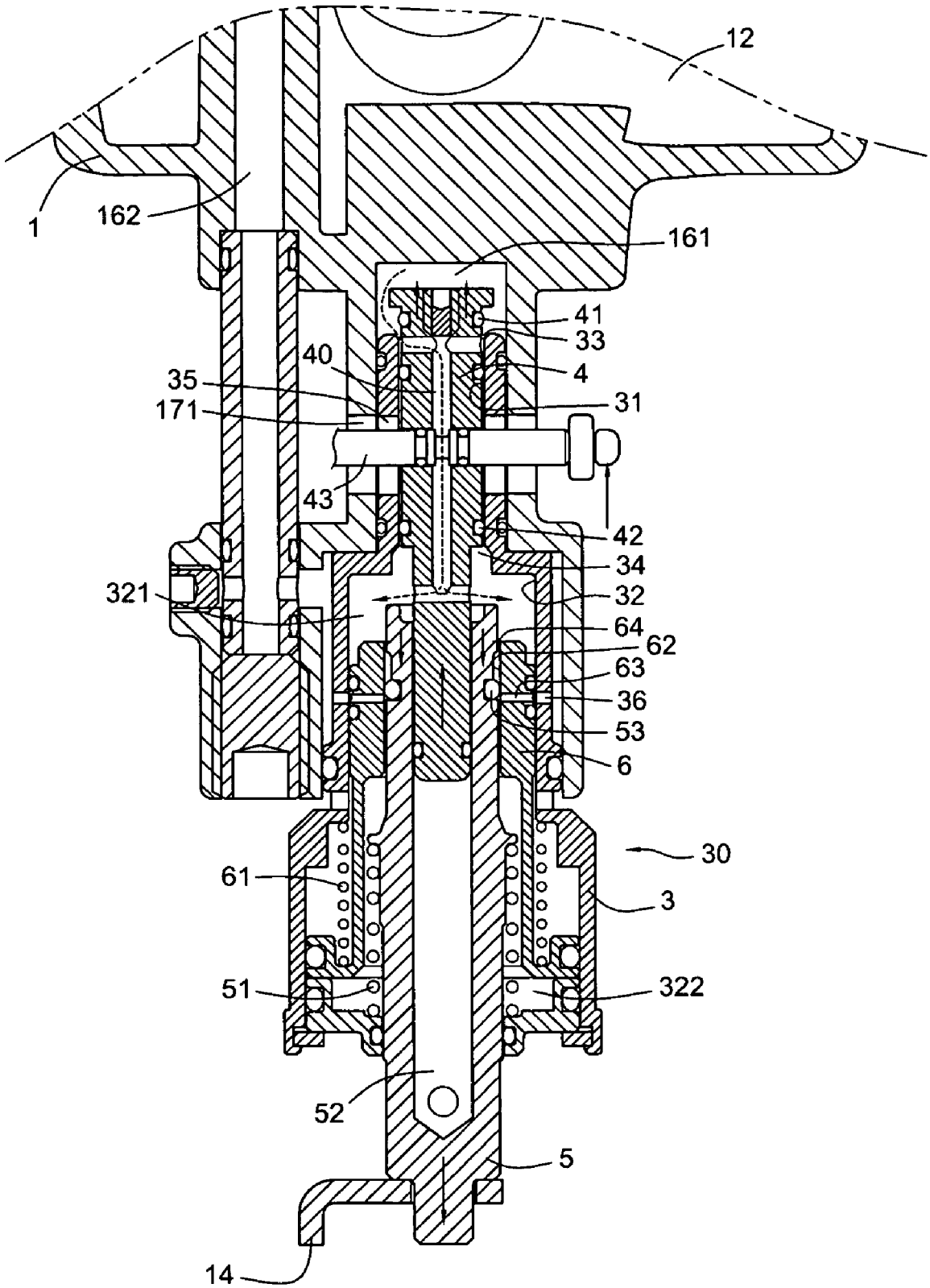
FIG. 18 is a view similar to FIG. 17, showing a status of the sliding portion having a shortened displacement.

Additionally, when a thickness or a depth of a through hole of one workpiece is larger than the predesigned height h2 (as shown in FIG. 13), the displacement h1 of the safety slide rod 14 and the sliding portion 5 is shortened. At this time, when the operator presses the trigger 13 (as shown in FIG. 18), the valve rod 4 is driven to open the first valve hole 33 and close the second valve hole 34. The high pressure air in the compressed chamber 12 flows into the first air room 321 of the bottom guide groove 32 via the first valve hole 33 and then drives the sliding portion 5 and the safety slide rod 14 to move along the hitting-nail direction. As a result, the hitting base 15 is driven to move to contact a surface of one workpiece at a position, which is above the workpiece 82 and does not reach the range of the predesigned height h2. Therefore, the sliding portion 5 is driven by the high pressure air to move, and this causes the third valve stopper 53 moving into the guide hole 62 above the through hole 63 along the hitting-nail direction, so as to prevent the third valve hole 64 from connecting with the through hole 63. Then, the nail gun 10 can not hit the nail 9.

Figure 19:
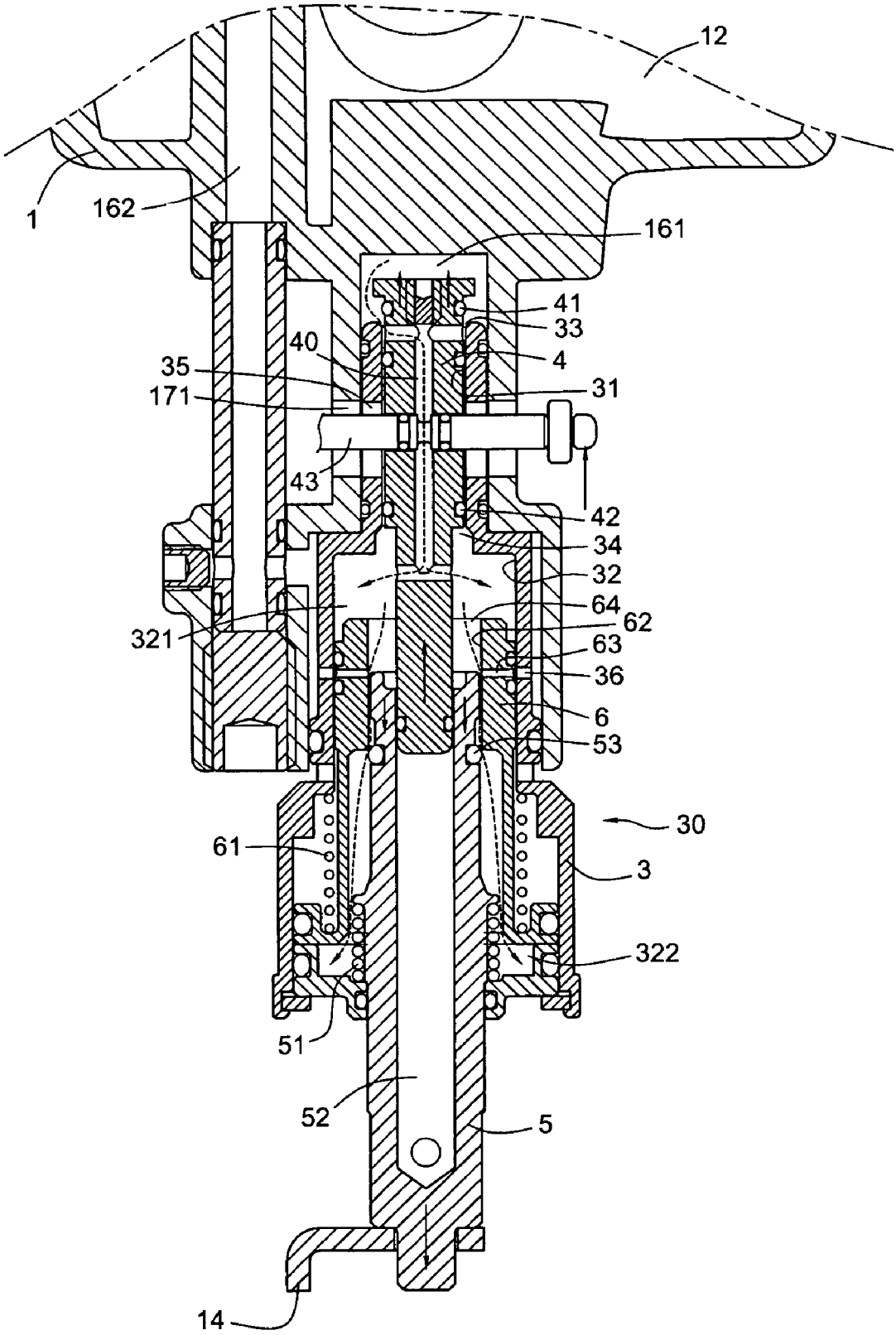
FIG. 19 is a view similar to FIG. 17, showing a status of the sliding portion having a lengthened displacement.
Figure 20:
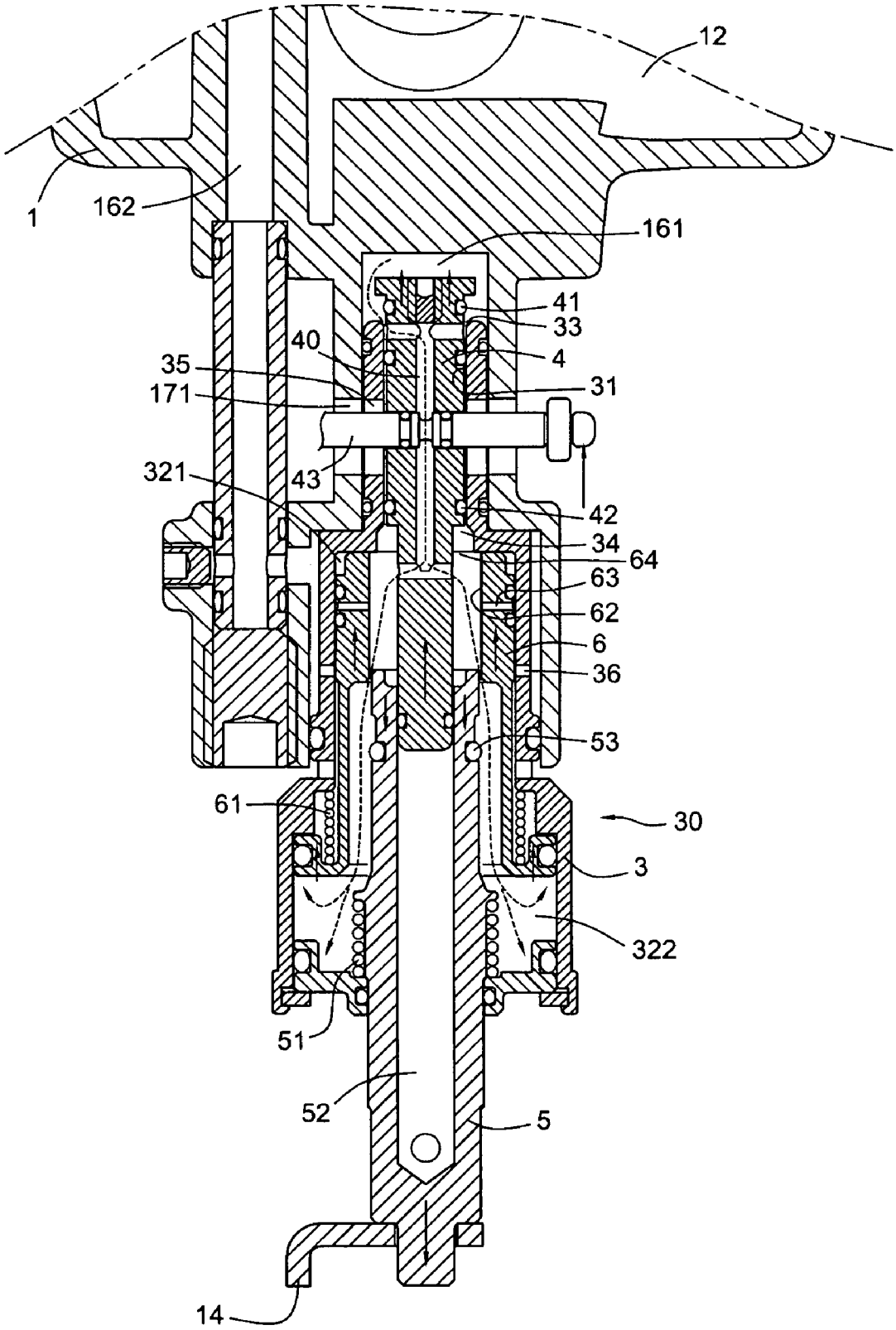
FIG. 20 is a view similar to FIG. 19, showing the continuously operating status thereof.
Figure 21:
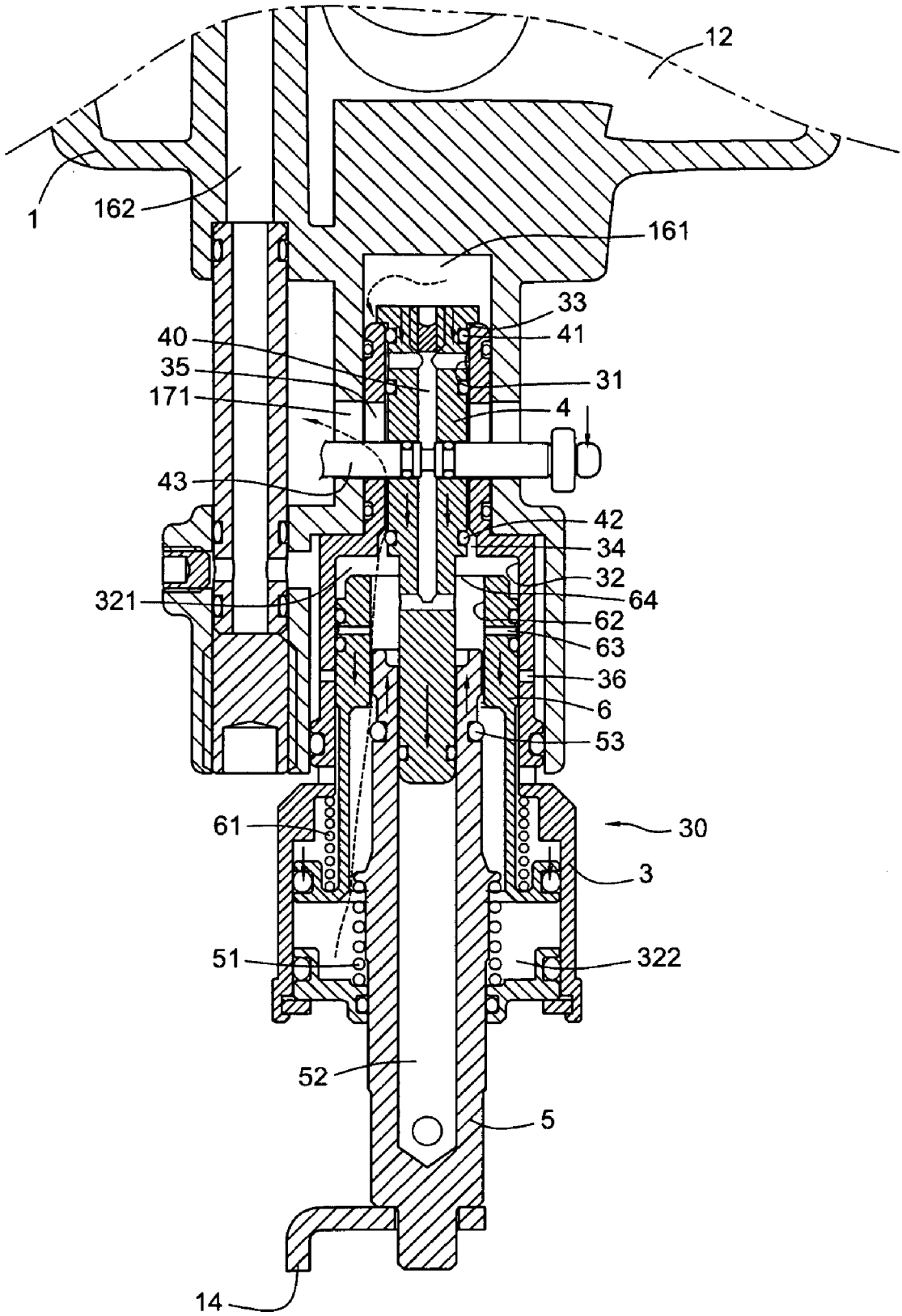
FIG. 21 is a view similar to FIG. 19, showing another continuously operating status thereof.

Moreover, when a thickness or a depth of a through hole of one workpiece is smaller than the predesigned height h2 (as shown in FIG. 13), the displacement h1 of the safety slide rod 14 and the sliding portion 5 is lengthened. At this time, when the operator presses the trigger 13 (as shown in FIG. 19), the valve rod 4 is driven to open the first valve hole 33 and close the second valve hole 34. The high pressure air in the compressed chamber 12 flows into the first air room 321 of the bottom guide groove 32 via the first valve hole 33 and then drives the sliding portion 5 and the safety slide rod 14 to move along the hitting-nail direction. As a result, the hitting base 15 is driven to move to contact a surface of one workpiece at a position, which is above the workpiece 82 and exceeds the range of the predesigned height h2. Therefore, the sliding portion 5 is driven by the high pressure air to move, and this causes the third valve stopper 53 moving away from the guide hole 62 along the hitting-nail direction and entering into the second air room 322, so as to open the third valve hole 64 to connect with the second air room 322. Then, the high pressure air in the first air room 321 flows into the second air room 322 via the third valve hole 64 and the guide hole 62, so as to concentrate high pressure air therein for driving the shuttle valve 6 to move along the direction opposite to the hitting-nail direction (as shown in FIG. 20). As a result, the through hole 63 is prevented from connecting with the air exhausting holes 36, and the nail gun 10 can not hit the nail 9. When the operator releases the trigger 13 (as shown in FIG. 21), the spring 131 and the high pressure air drive the valve rod 4 to reposit to original positions. The first valve stopper 41 is driven to close the first valve hole 33 so as to prevent the high pressure air from entering into the trigger valve 30 and the main air room 20. The second valve stopper 42 are driven by the valve rod 4 to open the second valve hole 34, then the high pressure air in the second air room 322 is exhausted to the atmosphere via the guide hole 62, the third valve hole 64, the second valve hole 34, the top guide groove 31, the travel slot 35 and the end slots 171. The spring 141 (as shown in FIG. 3) drives the safety slide rod 14 and the hitting base 15 to reposit again.

When the operator wants to nail the nail 9 into only the another workpiece to cause the hitting base 15 downwardly moving to the position, which is on the surface of the another workpiece and exceeds the range of the predesigned height h2, or the operator wrongly touches the trigger 13 to cause the hitting base 15 downwardly moving to the position, which is above the workpiece and exceeds the range of the predesigned height h2, the shuttle valve 6 will be driven to move along the direction opposite to the hitting-nail direction (as shown in FIG. 20) so as to prevent the through hole 63 from connecting with the air exhausting holes 36, and the nail gun 10 can not hit the nail 9.

As described above, structures such as drives for hitting nails and controls of hitting nails are integrated into the single trigger 13, this simplifies the nail gun and improves stability after long-time use of the nail gun. Furthermore, the safety slide rod 14 is directly driven by the sliding portion 5 to locate, this improves control stability.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A trigger valve of a pneumatic nail gun, comprising:

a valve base disposed at a gun body of the nail gun between a compressed chamber and a main air valve of the nail gun;

a valve rod sliding received in the valve base, being capable of being driven by a trigger of the nail gun to move so as to open or close high pressure air from the compressed chamber into the valve base;

a sliding portion sliding received in the valve base, being capable of being driven by high pressure air to move to cause a safety slide rod of the nail gun producing a displacement along a hitting-nail direction; and a shuttle valve sliding received in the valve base and nested with the sliding portion, the shuttle valve being capable of being driven to move under control of the displacement of the sliding portion so as to open or close high pressure air from the valve base into the main air valve, wherein the valve base includes a top guide groove and a bottom guide groove defined therein, the bottom guide groove connecting with the top guide groove; a first valve hole is disposed in a top end thereof, the first valve hole connecting with the compressed chamber and the top guide groove; the valve rod is sliding received in the top guide groove and includes an air-guiding passage defined therein, the air-guiding passage connecting the first valve hole and the bottom guide groove; the valve rod further includes a first valve stopper formed on an outer peripheral surface of a top end thereof, the first valve stopper being capable of controlling the first valve hole to open or close.

2. The trigger valve as claimed in claim 1, wherein the valve base is disposed at an end of the gun body.

3. The trigger valve as claimed in claim 1, wherein the air-guiding passage includes at least one air inputting passage, which is formed in the outer peripheral surface of the top end of the valve rod below the first valve stopper.

4. The trigger valve as claimed in claim 1, wherein the first valve stopper is located in the top guide groove and closes the first valve hole, and wherein when the trigger is pressed, the valve rod with the first valve stopper is driven to move along a direction opposite to the hitting-nail direction, and the first valve stopper moves to an outside of the top guide groove to open the first valve hole.

5. The trigger valve as claimed in claim 1, wherein a second valve hole is defined in a connecting portion between the top guide groove and the bottom guide groove; the valve base further includes at least one travel slot defined in a side portion thereof, the at least one travel slot connecting with the top guide groove and the atmosphere; the valve rod is sliding received in the top guide groove; a second valve stopper is disposed at an outer peripheral of the valve rod, which is located between the first and second guide grooves, the second valve stopper can open or close the second valve hole.

6. The trigger valve as claimed in claim 5, wherein the second valve stopper is located outside of the top guide groove and opens the second valve hole; and wherein when the trigger is pressed, the valve rod with the second valve stopper is driven to move along a direction opposite to the hitting-nail direction, and the second valve stopper moves into the top guide groove to close the second valve hole.

7. The trigger valve as claimed in claim 1, wherein the valve rod includes a pole sliding disposed at an end thereof, the pole is sliding received in the travel slot and exposed outside of side end portions of the valve base; the pole is capable of being driven by the trigger to drive the valve rod to move.

8. The trigger valve as claimed in claim 1, wherein the sliding portion is elastically and slidingly located in the bottom guide groove.

9. The trigger valve as claimed in claim 8, wherein a first elastic element is nested with the sliding portion, for inducing the sliding portion to move along a direction opposite to the hitting-nail direction.

10. The trigger valve as claimed in claim 8, wherein a bottom portion of the valve rod extends into the bottom guide groove, and an axial hole is formed in a top portion of the sliding portion and is nested with the bottom portion of the valve rod.

11. The trigger valve as claimed in claim 10, wherein the air-guiding passage includes at least one air exhausting passage, which is formed in an outer peripheral surface of the bottom portion of the valve rod.

12. The trigger valve as claimed in claim 8, wherein the sliding portion is connected with the safety slide rod.

13. The trigger valve as claimed in claim 1, wherein the shuttle valve is elastically and slidingly located in the bottom guide groove.

14. The trigger valve as claimed in claim 13, wherein a second elastic element is located between the shuttle valve and an inner wall of the bottom guide groove, for inducing the shuttle valve to move along the hitting nail direction.

15. The trigger valve as claimed in claim 13, wherein the valve base includes at least one air exhausting hole defined in a side portion thereof, the at least one air exhausting hole connecting with the bottom guide groove and the main air valve; the shuttle valve divides the bottom guide groove into a first air room and a second air room, the first air room connecting with the top guide groove; the shuttle valve includes a guide hole defined therein, which connects with the first air room and the second air room; the shuttle valve further includes at least one through hole defined in side portions thereof, the through hole connecting with the guide hole and the air exhausting hole; a third valve hole is defined in a connecting portion between the guide hole and the first air room; the sliding portion is sliding received in the guide hole and includes a third valve stopper formed on the outer periphery thereof, the third valve stopper is capable of controlling the third valve hole to open or close.

16. The trigger valve as claimed in claim 15, wherein the third valve stopper is located in the guide hole above the through hole and closes the third valve hole; the sliding portion is driven by high pressure air to cause the third valve stopper moving into the guide hole below the through hole along the hitting-nail direction so that the third valve hole is opened to connect with the through hole and the air exhausting hole.

17. The trigger valve as claimed in claim 15, wherein the third valve stopper is located in the guide hole above the through hole and closes the third valve hole; the sliding portion is driven by high pressure air to cause the third valve stopper moving away from the guide hole along the hitting-nail direction, so as to open the third valve hole to connect with the second air room so that the shuttle valve is driven by high pressure air to move along a direction opposite to the hitting-nail direction so as to block the air exhausting hole.

* * * * *